US010551759B2

(12) United States Patent
Watanabe et al.

(10) Patent No.: US 10,551,759 B2
(45) Date of Patent: Feb. 4, 2020

(54) TONER

(71) Applicant: CANON KABUSHIKI KAISHA, Tokyo (JP)

(72) Inventors: Hiroki Watanabe, Matsudo (JP); Toru Takahashi, Toride (JP); Yoshihiro Ogawa, Toride (JP); Daisuke Tsujimoto, Tokyo (JP); Wakashi Iida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/188,556

(22) Filed: Nov. 13, 2018

(65) Prior Publication Data

US 2019/0155182 A1 May 23, 2019

(30) Foreign Application Priority Data

Nov. 17, 2017 (JP) ..... 2017-221795

(51) Int. Cl.
*G03G 9/097* (2006.01)
*G03G 9/08* (2006.01)

(52) U.S. Cl.
CPC ..... *G03G 9/09708* (2013.01); *G03G 9/0819* (2013.01); *G03G 9/0823* (2013.01)

(58) Field of Classification Search
CPC ..... G03G 9/09708; G03G 9/0819
See application file for complete search history.

(56) References Cited

U.S. PATENT DOCUMENTS 3,725,283 A * 4/1973 Fenity ..... G03G 9/10 430/111.2
5,437,949 A 8/1995 Kanbayashi et al.
5,512,402 A 4/1996 Okado et al.
5,607,806 A 3/1997 Kanbayashi et al.
5,635,326 A 6/1997 Kanbayashi et al.
5,700,617 A 12/1997 Takiguchi et al.
5,747,209 A 5/1998 Takiguchi et al.
5,750,302 A 5/1998 Ogawa et al.
5,851,714 A 12/1998 Taya et al.
5,858,593 A 1/1999 Tamura et al.
5,912,099 A 6/1999 Kanbayashi et al.
5,922,500 A 7/1999 Iida et al.
5,976,752 A 11/1999 Matsunaga et al.
5,994,018 A 11/1999 Iida et al.
6,013,402 A 1/2000 Kanbayashi et al.
6,022,659 A 2/2000 Kanbayashi et al.
6,060,202 A 5/2000 Ogawa et al.
6,077,635 A 6/2000 Okado et al.
6,238,834 B1 5/2001 Tamura et al.
6,326,114 B1 12/2001 Itakura et al.
6,426,169 B1 7/2002 Onuma et al.
6,485,875 B1 11/2002 Karaki et al.
6,528,222 B2 3/2003 Kohtaki et al.
6,586,147 B2 7/2003 Iida et al.
6,664,016 B2 12/2003 Kanbayashi et al.
6,751,424 B2 6/2004 Komatsu et al.
6,808,852 B2 10/2004 Hotta et al.
6,875,549 B2 4/2005 Yamazaki et al.
6,881,527 B2 4/2005 Moribe et al.
7,001,703 B2 2/2006 Moribe et al.
7,115,349 B2 10/2006 Iida et al.
7,147,980 B2 12/2006 Itakura et al.
7,238,387 B2 7/2007 Ogawa et al.
7,368,211 B2 5/2008 Hasegawa et al.
7,422,832 B2 9/2008 Ogawa et al.
7,455,947 B2 11/2008 Ida et al.
7,470,494 B2 12/2008 Nishiyama et al.
7,544,457 B2 6/2009 Hashimoto et al.
7,582,401 B2 9/2009 Ogawa et al.
7,678,524 B2 3/2010 Hasegawa et al.
7,704,659 B2 4/2010 Ogawa et al.
7,811,734 B2 10/2010 Ogawa et al.
7,939,231 B2 5/2011 Ogawa et al.
8,084,174 B2 12/2011 Hasegawa et al.
8,124,306 B2 2/2012 Hirata et al.
8,501,377 B2 8/2013 Takahashi et al.
8,512,925 B2 8/2013 Moribe et al.
9,097,998 B2 8/2015 Yamazaki et al.
9,128,400 B2 9/2015 Takahashi et al.
9,158,217 B2 10/2015 Takahashi et al.
9,454,094 B2 9/2016 Tsujimoto et al.
9,470,993 B2 10/2016 Nishikawa et al.
9,500,975 B2 11/2016 Sugahara et al.
9,599,920 B2 3/2017 Sugahara et al.
(Continued)

FOREIGN PATENT DOCUMENTS

DE 60223840 * 1/2008 ..... G03G 9/0819
DE 102015112927 2/2016
(Continued)

OTHER PUBLICATIONS

Chen, W.; Fan, H.; Long, C. "Effects of sintering time on crystal structure, dielectric properties and conductivity of (Ca0.8Sr0.2)ZrO3 ceramics" J Mater Sci: Mater Electron (2014) 25:1505-1511.*
Lei, J.; Liu, X.; Yan, T.; Chen, J. "Preparation and Characterization of Ca0.8Sr0.2ZrO3 Powders Prepared by Soft Chemical Route" Key Engineering Materials (2007), 336-338 (Pt. 2, High-Performance Ceramics IV), 968-970.*
Tarrida, M.; Larguem, H.; Madon, M. "Structural investigations of (Ca,Sr)ZrO3 and Ca(Sn,Zr)O3 perovskite compounds" Phys Chem Minerals (2009) 36:403-413.*
English language machine translation of JP 8-248674 (1996).*
(Continued)

*Primary Examiner* — Christopher D Rodee
(74) *Attorney, Agent, or Firm* — Venable LLP

(57) ABSTRACT

A toner having: a toner particle including a binder resin; and an inorganic fine particle, wherein the inorganic fine particle includes a calcium strontium zirconate fine particle.

5 Claims, 1 Drawing Sheet

(56) References Cited

U.S. PATENT DOCUMENTS

| | | | |
|---|---|---|---|
| 9,606,466 | B2 | 3/2017 | Takahashi et al. |
| 9,703,216 | B2 | 7/2017 | Tsuchida et al. |
| 9,778,598 | B2 | 10/2017 | Onozaki et al. |
| 9,785,070 | B2 | 10/2017 | Sugahara et al. |
| 9,958,809 | B2 | 5/2018 | Sugahara et al. |
| 10,007,206 | B2 | 6/2018 | Sugahara et al. |
| 2002/0055053 | A1 | 5/2002 | Kasaya et al. |
| 2004/0110076 | A1 | 6/2004 | Yamazaki et al. |
| 2012/0270720 | A1 | 10/2012 | Tanabe |
| 2013/0252167 | A1 | 9/2013 | Moribe et al. |
| 2013/0309603 | A1 | 11/2013 | Takahashi et al. |
| 2014/0004460 | A1 | 1/2014 | Yoshiba et al. |
| 2016/0041520 | A1 | 2/2016 | Akiyama et al. |
| 2018/0231903 | A1 | 8/2018 | Sugahara et al. |
| 2018/0246429 | A1 | 8/2018 | Takahashi et al. |

FOREIGN PATENT DOCUMENTS

| | | | | | |
|---|---|---|---|---|---|
| JP | H05-323657 | | | 12/1993 | |
| JP | 08248674 | A | * | 9/1996 | |
| JP | H10-048888 | | | 2/1998 | |
| JP | 2013-025223 | | | 2/2013 | |
| JP | 2013025223 | A | * | 2/2013 | |
| KR | 20030053023 | A | * | 6/2003 | ..... G03G 9/0836 |

OTHER PUBLICATIONS

English language machine translation of JP 2013-025223 (2013).*
English langauge machine translation of KR 2003-0053023 (2003).*

* cited by examiner

TONER

BACKGROUND OF THE INVENTION

Field of the Invention

The present invention relates to electrophotography, an image forming method for visualizing an electrostatic image, and a toner for use in a toner jet.

Description of the Related Art

In recent years, as image forming apparatus such as copying machines and printers have become widespread, stable output of images of excellent quality in various usage environments is considered as a performance feature required for image forming apparatus.

Further, focusing on the adaptability of toner to various environments, humidity can be mentioned as a factor which is particularly influential among environmental factors. Humidity affects the charge quantity and charge quantity distribution of the toner, and greatly affects image density, fogging, and transferability.

In the step of transferring the toner developed on the surface of an electrostatic image bearing member from the surface of the electrostatic image bearing member to paper, the toner is transferred by applying a charge of a polarity opposite to that of the toner to the paper from the back side of the paper and charging the surface of the paper to a polarity opposite to the polarity of the toner.

At this time, although essentially only the surface of the paper needs to be charged, depending on the kind of paper and humidity, in some cases, the electric charge passes from the back of the paper to the front side, and the toner on the surface of the electrostatic image bearing member is also charged. At this time, the toner is charged to the polarity opposite to the original polarity.

This phenomenon is called "penetration at the time of transfer". When penetration at the time of transfer occurs, the toner is not transferred onto paper but remains on the surface of the electrostatic image bearing member, or the toner image at the time of transfer is disturbed and halftone non-uniformity and scattering can occur.

Such a phenomenon becomes particularly noticeable when image output is performed by using paper which has absorbed moisture under a high-temperature and high-humidity environment.

Japanese Patent Application Laid-open No. 5-323657 discloses a single-component developer having a stannate or zirconate having a length average diameter of from 0.1 μm to 10 μm.

Japanese Patent Application Laid-open No. 10-48888 discloses a developer including first inorganic fine particles which have been surface-treated with at least one surface treatment agent selected from an aminosilane coupling agent and an aminosilicone oil and have a number average particle size in the range of from 0.1 μm to 3 μm, and second inorganic fine particles which have been subjected to hydrophobic treatment and have an average primary particle diameter in the range of from 0.005 μm to 0.02 μm.

Japanese Patent Application Laid-open No. 2013-25223 discloses a toner having composite inorganic particles in which a carbonate is unevenly distributed on the surface of a composite metal oxide of an alkaline earth metal and titanium or zirconium.

SUMMARY OF THE INVENTION

In the developer disclosed in Japanese Patent Application Laid-open No. 5-323657, the effect produced by the external addition of a stannate or zirconate having a length average diameter of 0.1 μm to 10 μm to the toner surface is that high-quality images with high image density and small fogging are provided over a long time.

The developer disclosed in Japanese Patent Application Laid-open No. 10-48888 includes first inorganic fine particles which have been surface-treated with at least one surface treatment agent selected from an aminosilane coupling agent and an aminosilicone oil and have an average particle diameter in the range of from 0.1 μm to 3 μm, and second inorganic fine particles which have been subjected to hydrophobic treatment and have a number average primary particle diameter in the range of from 0.005 μm to 0.02 μm. The surface of an amorphous silicon based photosensitive member is polished by the first inorganic fine particles to suppress filming of a filler such as talc and calcium carbonate and toner components on the surface of the amorphous silicon photosensitive member. Further, the fluidity of the developer is improved by the second inorganic fine particles, and the positively chargeable toner is properly charged, so that the toner is prevented from scattering and the occurrence of fogging or image density non-uniformity in the formed image is suppressed. The resulting effect is that good image can be stably obtained.

The toner disclosed in Japanese Patent Application Laid-open No. 2013-25223 includes composite inorganic particles in which a carbonate is unevenly distributed on the surface of a composite metal oxide of an alkaline earth metal and titanium or zirconium. The resulting effect is that image smearing due to surface deterioration of the photosensitive member is prevented and image quality deterioration is suppressed even in image formation over a long period of time.

However, since the toners disclosed in Japanese Patent Application Laid-open No. 5-323657, 10-48888 and 2013-25223 are not designed by taking into account the penetration at the time of transfer, the performance thereof is insufficient in terms of outputting an image in which halftone non-uniformity and scattering under a high-temperature and high-humidity environment are suppressed.

The present invention is accomplished to solve the above-mentioned problems. That is, the present invention provides a toner which does not cause halftone non-uniformity and scattering even when used under a high-temperature and high-humidity environment.

The present invention relates to a toner having a toner particle including a binder resin and an inorganic fine particle, wherein the inorganic fine particle includes a calcium strontium zirconate fine particle.

According to the present invention, it is possible to provide a toner which does not cause halftone non-uniformity and scattering even when used under a high-temperature and high-humidity environment.

Further features of the present invention will become apparent from the following description of exemplary embodiments with reference to the attached drawing.

DESCRIPTION OF THE EMBODIMENTS

Figure 1A:
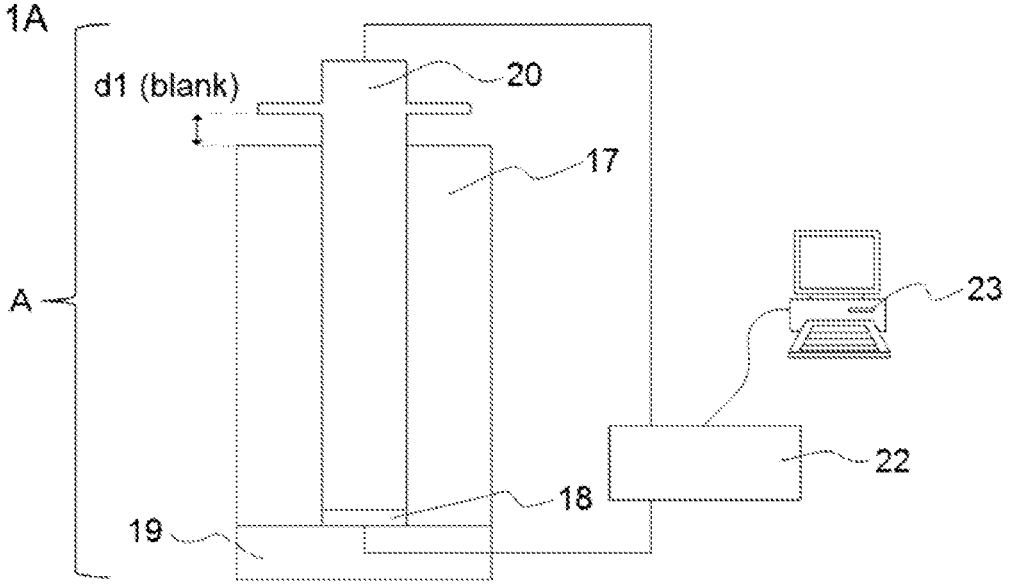
FIGS. 1A and 1B are schematic diagrams of a device for measuring a resistivity.

In the present invention, the expression "from XX to YY" and "XX to YY" representing a numerical range means a numerical range including a lower limit and an upper limit which are endpoints unless otherwise specified.

The toner according to the present invention is a toner having a toner particle including a binder resin and an inorganic fine particle, wherein the inorganic fine particle includes a calcium strontium zirconate fine particle.

According to the research conducted by the inventors of the present invention, by using the toner, it is possible to provide a toner which does not cause halftone non-uniformity and scattering due to the penetration at the time of transfer even when used under a high-temperature and high-humidity environment.

The reason why the toner achieves excellent effects unattainable in the related art is considered hereinbelow.

In the present invention, the penetration at the time of transfer refers to the following phenomenon.

In the transfer step, a charge having a polarity opposite to that of the toner is applied to the paper from the back side of the paper as a transfer medium, and the surface of the paper is charged to a polarity opposite to the polarity of the toner. The phenomenon occurring at this time is that essentially only the surface of paper needs to be charged, the electric charge passes from the back of the paper to the front side, and the toner on the surface of the electrostatic image bearing member is also charged. At this time, the toner is charged to the polarity opposite to the original polarity.

When paper resistance is low, electric charges tend to flow easily, so the penetration at the time of transfer is likely to occur when images are outputted using paper moistened under a high-temperature and high-humidity environment.

The toner has a strontium calcium zirconate fine particle on the surface of the toner particle. Then, the calcium strontium zirconate fine particle prevents the toner from being charged to the opposite polarity due to the penetration at the time of transfer.

The calcium strontium zirconate fine particle usually has a perovskite type crystal structure. In the perovskite type crystal structure, a cation of zirconium is arranged in the body center of a unit lattice, cations of calcium or strontium are arranged at each apex, and oxygen anions are arranged in the face centers of the unit lattice with the cation of zirconium as the center.

Calcium ions and strontium ions present at each apex of the unit lattice have different ionic radii. The electron cloud of oxygen ions (the distribution of electrons around the nucleus) arranged in the face center of the unit lattice is affected by calcium ions and strontium ions.

The presence of two cations with different ionic radii of calcium ions or strontium ions at each apex of the unit lattice distorts the electron cloud of oxygen ions. As a result of distortion, the electron cloud of oxygen ions becomes large and is more likely to receive the positive electric charge.

Since the calcium strontium zirconate fine particle is likely to receive a positive charge for the reasons as described above, positive charges due to the penetration at the time of transfer move selectively to the calcium strontium zirconate fine particle present on the surface of the toner particle.

Therefore, the charging of the toner is kept negative, and the toner is appropriately transferred to the paper. As a result, it is possible to provide a toner such that the penetration at the time of transfer is unlikely to occur and halftone non-uniformity and scattering do not occur even under a high-temperature and high-humidity environment.

A calcium zirconate fine particle and a strontium zirconate fine particle usually have a perovskite crystal structure similarly to the calcium strontium zirconate fine particle.

However, in the calcium zirconate fine particle or the strontium zirconate fine particle, since only an ion of one kind among the calcium ion and strontium ion is present at each apex of the unit lattice of the crystal structure, distortion is hardly generated in the electron cloud of oxygen ions.

Therefore, since the calcium zirconate fine particle and the strontium zirconate fine particle are less likely to receive a positive charge than the calcium strontium zirconate fine particle, the toner is likely to be positively charged due to the penetration at the time of transfer, and the effect of improving halftone non-uniformity and scattering is difficult to obtain.

In an X-ray diffraction spectrum using a CuKα ray, the calcium strontium zirconate fine particle preferably has a maximum peak of a diffraction angle 2θ in the range of from 30.90 deg to 31.42 deg.

When the diffraction angle 2θ of the calcium strontium zirconate fine particle has the maximum peak within the above range, halftone non-uniformity and scattering in a high-temperature and high-humidity environment can be further suppressed.

The maximum peak of the diffraction angle 2θ can be controlled by the molar ratio of zirconium, calcium and strontium and the like when preparing the calcium strontium zirconate fine particle in a step of separately dispersing each of zirconium oxide, calcium carbonate and strontium carbonate as raw materials in water and then mixing the slurries.

In a typical calcium zirconate, in the X-ray diffraction spectrum using a CuKα ray, the diffraction angle 2θ has a maximum peak in the range of from 31.48 deg to 31.56 deg.

Meanwhile, in a typical strontium zirconate, in the X-ray diffraction spectrum using a CuKα ray, the diffraction angle 2θ has a maximum peak in the range of from 30.76 deg to 30.84 deg. That is, it can be seen that the calcium strontium zirconate fine particle is a substance different from calcium zirconate and strontium zirconate.

When in the calcium strontium zirconate fine particle, the diffraction angle 2θ has a maximum peak in the range of from 30.90 deg to 31.42 deg in the X-ray diffraction spectrum using a CuKα ray, the balance between the calcium ion and the strontium ion arranged in each apex of the unit lattice becomes favorable and it becomes easier to receive positive charges.

The calcium strontium zirconate fine particle preferably has a dielectric constant of from 20 pF/m to 125 pF/m, and more preferably of from 50 pF/m to 110 pF/m.

As a result of controlling the dielectric constant of the calcium strontium zirconate fine particle within the above range, when positive charges on the back surface of the paper move to the toner due to the penetration at the time of transfer under a high-temperature and high-humidity environment, positive charges are likely to move selectively to the oxygen ions of the calcium strontium zirconate fine particles on the surface of the toner, so that halftone non-uniformity and scattering can be further suppressed.

The dielectric constant can be controlled by the number-average particle diameter of primary particles of zirconium oxide, calcium carbonate and strontium carbonate as raw materials, the temperature of spray drying at the time of producing the strontium calcium zirconate fine particles, and the temperature and time of sintering.

The calcium strontium zirconate fine particle preferably has a resistivity of from $1.0\times10^{7}$ Ω·cm to $1.0\times10^{12}$ Ω·cm, and more preferably of from $1.0\times10^{7}$ Ω·cm to $1.0\times10^{10}$ Ω·cm.

By setting the resistivity of the calcium strontium zirconate fine particle within the above range, it is possible to provide a toner which has a high image density and suppressed occurrence of fogging over a long period of time under a low-temperature and low-humidity environment.

Generally, in a low-temperature and low-humidity environment, the toner is likely to be excessively charged.

By controlling the resistivity of the calcium strontium zirconate fine particle within the above range, it is possible to provide a toner which has a high image density and suppressed occurrence of fogging over a long period of time even in a low-temperature and low-humidity environment while maintaining the effect of not causing halftone non-uniformity and scattering under a high-temperature and high-humidity environment because of an effect of leakage of excessive charging of the toner.

The resistivity can be controlled by the purity of zirconium oxide, calcium carbonate and strontium carbonate as raw materials, the temperature of spray drying at the time of producing the strontium calcium zirconate fine particles, and the temperature and time of sintering.

The amount of the calcium strontium zirconate fine particle is preferably from 0.05 parts by mass to 10.0 parts by mass, more preferably from 0.05 parts by mass to 5.0 parts by mass, and still more preferably from 0.1 parts by mass to 3.0 parts by mass with respect to 100 parts by mass of the toner particle.

When the amount of the calcium strontium zirconate fine particle is within the above range, the effect of suppressing charging of the toner to the polarity opposite to the original polarity due to the penetration at the time of transfer and the effect of suppressing excessive charging of the toner are easily obtained. As a result, halftone non-uniformity and scattering under a high-temperature and high-humidity environment are further suppressed. Further, it is possible to provide a toner which has a high image density and suppressed occurrence of fogging over a long period of time under a low-temperature and low-humidity environment.

The number-average particle diameter of primary particles of the calcium strontium zirconate fine particle is preferably from 10 nm to 800 nm, and more preferably from 30 nm to 350 nm.

When the number-average particle diameter of the primary particles of the calcium strontium zirconate fine particles is in the above range, the calcium strontium zirconate fine particles are effectively finely dispersed on the surface of the toner particles. As a result, it is easy to obtain the effect of suppressing charging of the toner to the opposite polarity due to penetration at the time of transfer and the effect of suppressing excessive charging of the toner. As a result, halftone non-uniformity and scattering under a high-temperature and high-humidity environment are further suppressed. Further, it is possible to provide a toner which has a high image density and suppressed occurrence of fogging over a long period of time under a low-temperature and low-humidity environment.

When all the elements of the calcium strontium zirconate fine particle detected by fluorescent X-ray analysis are regarded as oxides and the total amount of all oxides is taken as 100 mol %, where the amount of zirconium oxide is denoted by X mol %, the amount of calcium oxide is denoted by Y mol %, and the amount of strontium oxide is denoted by Z mol %, X/(Y+Z) is preferably from 0.90 to 1.10 (more preferably from 0.95 to 1.05), X+Y+Z is preferably from 90 to 100 (more preferably from 95 to 100), and Y and Z are each preferably from 10 to 40 (more preferably from 14 to 40).

The fact that X/(Y+Z) is from 0.90 to 1.10 means that the ratio of the number of zirconium ions to the number of calcium ions and strontium ions is close to 1:1.

As a result of making the ratio of the number of zirconium ions to the number of calcium ions and strontium ions close to 1:1, calcium strontium zirconate is likely to take a perovskite type structure with fewer defects. Therefore, it is easy to obtain the effect of suppressing the charging of the toner to the opposite polarity due to the penetration at the time of transfer and the effect of suppressing excessive charging of the toner. As a result, halftone non-uniformity and scattering are further suppressed under a high-temperature and high-humidity environment. Further, it is possible to provide a toner which has a high image density and suppressed occurrence of fogging over a long period of time under a low-temperature and low-humidity environment.

The fact that X+Y+Z is 90 or more means that the purity of calcium strontium zirconate is high. Since the purity of calcium strontium zirconate is high, it is easy to obtain the effect of suppressing the charging of the toner to the polarity opposite to the original polarity due to the penetration at the time of transfer and the effect of suppressing excessive charging of the toner. As a result, halftone non-uniformity and scattering are further suppressed under a high-temperature and high-humidity environment. Further, it is possible to provide a toner which has a high image density and suppressed occurrence of fogging over a long period of time under a low-temperature and low-humidity environment.

The fact that Y and Z are each 10 or more means that the amount of either one of calcium ion and strontium ion in calcium strontium zirconate is not extremely small. The proper amount of calcium ion and strontium ion in calcium strontium zirconate makes it possible to obtain easily the effect of suppressing the charging of the toner to the opposite polarity due to the penetration at the time of transfer and the effect of suppressing excessive charging of the toner. As a result, halftone non-uniformity and scattering under a high-temperature and high-humidity environment are further suppressed. Further, it is possible to provide a toner which has a high image density and suppressed occurrence of fogging over a long period of time under a low-temperature and low-humidity environment.

If necessary, the calcium strontium zirconate fine particle may be subjected to a surface treatment with a surface treatment agent for the purpose of hydrophobization and triboelectric charging control.

Examples of the surface treatment agent include an unmodified silicone varnish, various modified silicone varnishes, unmodified silicone oils, various modified silicone oils, a silane coupling agent, a silane compound having a functional group, or other organosilicon compounds. These surface treatment agents may be used singly or in combination of two or more kinds thereof.

A method for producing the calcium strontium zirconate fine particle is not particularly limited, and a well-known production method based on a solid phase method or a wet method can be used.

The solid phase method is described hereinbelow.

For example, a mixture including zirconium oxide, calcium carbonate and strontium carbonate is washed, dried and sintered, mechanically pulverized and classified to obtain calcium strontium zirconate fine particles.

In this case, zirconium oxide which is a raw material is not particularly limited as long as it is a substance having a $ZrO_2$ composition.

In addition, calcium carbonate and strontium carbonate which are raw materials are not particularly limited as long as they are substances having $CaCO_3$ and $SrCO_3$ compositions.

However, when calcium strontium zirconate fine particles are obtained by sintering and subsequent pulverization, the particle size distribution tends to be uneven.

In order to obtain calcium strontium zirconate fine particles having a uniform particle size distribution by the solid phase method, it is preferable that the number-average particle diameter of the primary particles of zirconium oxide, calcium carbonate and strontium carbonate as raw materials be from 5 nm to 200 nm.

In addition, it is preferable that the amount of impurities contained in zirconium oxide, calcium carbonate and strontium carbonate as raw materials are small. When impurities are contained in a large amount, impurities melt during the production of calcium strontium zirconate fine particles, and calcium strontium zirconate fine particles tend to be sintered, so that fine particles of calcium strontium zirconate are difficult to form. The purity of zirconium oxide, calcium carbonate and strontium carbonate is preferably 90.0% or more.

In addition, the following solid phase method can also be mentioned.

A slurry of a mixture is prepared by uniformly wet-mixing zirconium oxide, calcium carbonate and strontium carbonate in the presence of water.

The slurry of the mixture is spray dried and then sintered to obtain strontium calcium zirconate.

For spray drying, an ordinary spray drying apparatus can be used. The drying temperature of the slurry is preferably from 120° C. to 300° C.

By spray-drying the slurry of the mixture in the drying temperature range, calcium strontium zirconate fine particles having uniform particle size distribution can be obtained.

The sintering temperature of calcium strontium zirconate is preferably from 600° C. to 950° C. Calcium strontium zirconate fine particles having uniform particle size distribution can be obtained by setting the sintering temperature of calcium strontium zirconate to the above range.

The toner may include external additives other than the calcium zirconium strontium fine particle for improving performance such as charging stability, developing performance, flowability, durability and the like.

Examples of the external additive include resin fine particles and inorganic fine particles that act as a charging aid, a conductivity imparting agent, a flowability imparting agent, a caking inhibitor, a releasing agent at the time of heated roller fixing, a lubricant, a polishing agent, and the like. Examples of the lubricant include polyethylene fluoride fine particles, zinc stearate fine particles, and polyvinylidene fluoride fine particles. Examples of the polishing agent include cerium oxide fine particles, silicon carbide fine particles, and strontium titanate fine particles.

The preferred examples of the inorganic fine particles are silica fine particles.

The silica fine particles preferably have a specific surface area of from 30 $m^2/g$ to 500 $m^2/g$, and more preferably from 50 $m^2/g$ to 400 $m^2/g$ as determined by the BET method based on nitrogen adsorption. The amount of the silica fine particles is preferably from 0.01 parts by mass to 8.0 parts by mass, and more preferably from 0.10 parts by mass to 5.0 parts by mass with respect to 100 parts by mass of the toner particle.

If necessary, the silica fine particles may be treated with a treatment agent such as an unmodified silicone varnish, various modified silicone varnishes, unmodified silicone oils, various modified silicone oils, a silane coupling agent, a silane compound having a functional group, or other organosilicon compounds for the purpose of hydrophobization and triboelectric charging control.

The binder resin is not particularly limited, and known resins for toners can be used.

Specific examples of the resin include a styrene resin, a styrene copolymer resin, a polyester resin, a polyol resin, a polyvinyl chloride resin, a phenolic resin, a phenolic resin modified with a natural resin, a maleic acid resin modified with a natural resin, an acrylic resin, a methacrylic resin, a polyvinyl acetate resin, a silicone resin, a polyurethane resin, a polyamide resin, a furan resin, an epoxy resin, a xylene resin, a polyvinyl butyral resin, a terpene resin, a coumarone-indene resin and a petroleum-based resin, preferably a styrene copolymer resin, a polyester resin, and a hybrid resin in which a polyester resin and a styrene copolymer resin are mixed or partially reacted with each other.

From the viewpoint of storage stability, the glass transition temperature (Tg) of the binder resin is preferably 45° C. or higher. From the viewpoint of low-temperature fixability, the Tg is preferably 75° C. or lower, and more preferably 70° C. or lower.

The glass transition temperature (Tg) may be measured under normal temperature and normal humidity in accordance with ASTM D 3418-82 using a differential scanning calorimeter (DSC) "MDSC-2920, manufactured by TA Instruments".

Specifically, about 3 mg of a binder resin is accurately weighed and placed in an aluminum pan. Meanwhile, an empty aluminum pan is used as a reference.

The temperature is raised from 30° C. to 200° C. at a heating rate of 10° C./min with the measurement temperature range set from 30° C. to 200° C., the temperature is thereafter decreased from 200° C. to 30° C. at a cooling rate of 10° C./min, and the temperature is then again raised to 200° C. at a heating rate of 10° C./min.

In the DSC curve obtained in this second heating process, the intersection of the line at the midpoint of the baseline before and after the specific heat change appears and the DSC curve is taken as the glass transition temperature (Tg).

The toner particle may include a releasing agent (wax) so as to impart releasability.

Examples of the wax are presented hereinbelow.

Aliphatic hydrocarbon waxes such as low-molecular-weight polyethylene, low-molecular-weight polypropylene, olefin copolymers, microcrystalline wax, paraffin wax and Fischer Tropsch wax; oxidized wax of aliphatic hydrocarbon wax such as oxidized polyethylene wax; waxes including a fatty acid ester as the main component, such as carnauba wax, behenyl behenate, montanic acid ester wax and the like; waxes obtained by partial or complete deoxidation of fatty acid esters, such as deoxidized carnauba wax; saturated linear fatty acids such as palmitic acid, stearic acid, montanic acid and the like; unsaturated fatty acids such as brassidic acid, eleostearic acid, parinaric acid and the like; saturated alcohols such as stearyl alcohol, aralkyl alcohol, behenyl alcohol, carnaubyl alcohol, ceryl alcohol, myricyl alcohol and the like; polyhydric alcohols such as sorbitol and the like; fatty acid amides such as linoleic acid amide, oleic acid amide, lauric acid amide and the like; saturated fatty acid bisamides such as methylene bis-stearic acid amide, ethylene bis-capric acid amide, ethylene bis-lauric acid amide, hexamethylene bis-stearic acid amide and the like; unsaturated fatty acid amides such as ethylene bis-oleic acid amide, hexamethylene bis-oleic acid amide, N,N'- dioleyl adipic acid amide, N,N'-dioleoyl sebacic acid amide and the like; aromatic bisamides such as m-xylene bis-stearic acid amide, N, N'-distearyl isophthalic acid amide and the like; aliphatic metal salts calcium stearate, calcium laurate, zinc stearate, magnesium stearate and the like (commonly referred to as metallic soaps); waxes obtained by grafting aliphatic hydrocarbon waxes with a vinyl copolymer monomer such as styrene or acrylic acid; partially esterified products of fatty acids and polyhydric alcohols such as behenic acid monoglyceride and the like; and methyl ester compounds having a hydroxy group obtained by hydrogenation of a vegetable oil or the like Of these, aliphatic hydrocarbon waxes such as low-molecular-weight polyethylene, polypropylene, Fischer-Tropsch wax, paraffin wax and the like are preferable.

As for the timing of adding the wax, the wax may be added at the time of toner production or at the time of production of the binder resin. Further, one kind of these waxes may be used alone, or two or more kinds of waxes may be used in combination. The amount of the wax is preferably from 1 part by mass to 20 parts by mass with respect to 100 parts by mass of the binder resin.

The toner can be used in any form such as a magnetic single-component developer, a nonmagnetic single-component developer, and a nonmagnetic two-component developer.

In the case of a magnetic single-component developer, a magnetic material is preferably used as a colorant. Examples of the magnetic material include magnetic iron oxide such as magnetite, maghemite, ferrite, and magnetic iron oxides including other metal oxides; metals such as Fe, Co, and Ni, or alloys of these metals with metals such as Al, Co, Cu, Pb, Mg, Ni, Sn, Zn, Sb, Be, Bi, Cd, Ca, Mn, Se, Ti, W, and V, and mixtures thereof.

The amount of the magnetic material is preferably from 30 parts by mass to 100 parts by mass with respect to 100 parts by mass of the binder resin.

In the case of a nonmagnetic single-component developer and a nonmagnetic two-component developer, the colorant can be exemplified by the following materials.

Examples of the black pigment include carbon blacks such as furnace black, channel black, acetylene black, thermal black and lamp black. Magnetic materials such as magnetite, ferrite and the like can also be used.

Yellow colorants can be exemplified by the following pigments or dyes.

Examples of the pigment include C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191, C. I. Vat Yellow 1, 3, and 20.

Examples of the dye include C. I. Solvent Yellow 19, 44, 77, 79, 81, 82, 93, 98, 103, 104, 112, 162.

These can be used singly or in combination of two or more thereof.

Cyan colorants can be exemplified by the following pigments or dyes.

Examples of the pigment include C. I. Pigment Blue 1, 7, 15, 15:1, 15:2, 15:3, 15:4, 16, 17, 60, 62, 66, C. I. Vat Blue 6, and C. I. Acid Blue 45.

Examples of the dye include C. I. Solvent Blue 25, 36, 60, 70, 93, 95.

These can be used singly or in combination of two or more thereof.

Magenta colorants can be exemplified by the following pigments or dyes.

Examples of the pigment include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, and 254; C. I. Pigment Violet 19; C. I. Vat Red 1, 2, 10, 13, 15, 23, 29, and 35.

Examples of the dye include oil-soluble dyes such as C. I. Solvent Red 1, 3, 8, 23, 24, 25, 27, 30, 49, 52, 58, 63, 81, 82, 83, 84, 100, 109, 111, 121, and 122; C. I. Disperse Red 9; C. I. Solvent Violet 8, 13, 14, 21, 27, and C. I. Disperse Violet 1; and basic dyes such as C. I. Basic Red 1, 2, 9, 12, 13, 14, 15, 17, 18, 22, 23, 24, 27, 29, 32, 34, 35, 36, 37, 38, 39, and 40, C. I. Basic Violet 1, 3, 7, 10, 14, 15, 21, 25, 26, 27 and 28.

These can be used singly or in combination of two or more thereof.

The amount of the colorant is preferably from 1 part by mass to 20 parts by mass with respect to 100 parts by mass of the binder resin.

The toner can use a well-known charge control agent.

Examples of the charge control agent include azo iron compounds, azo chromium compounds, azo manganese compounds, azo cobalt compounds, azo zirconium compounds, chromium compounds of carboxylic acid derivatives, zinc compounds of carboxylic acid derivatives, aluminum compounds of carboxylic acid derivatives, and zirconium compounds of carboxylic acid derivatives.

For the carboxylic acid derivative, an aromatic hydroxycarboxylic acid is preferable. A charge control resin can also be used. The charge control agents may be used singly or in combination of two or more thereof. The amount of the charge control agent and the charge control resin is preferably from 0.1 parts by mass to 10 parts by mass with respect to 100 parts by mass of the binder resin.

As described above, the toner may be mixed with a carrier and used as a two-component developer.

As the carrier, usual carriers such as ferrite, magnetite and the like and resin-coated carriers can be used. Also, a binder-type carrier in which a magnetic material is dispersed in a resin can be used.

The resin-coated carrier is composed of a carrier core particle and a coating material which is a resin that coats (covers) the surface of the carrier core particle. Examples of the resin used for the coating material include styrene-acrylic resins such as styrene-acrylic acid ester copolymers, styrene-methacrylic acid ester copolymers and the like; acrylic resins such as acrylic acid ester copolymers, methacrylic acid ester copolymers and the like; fluororesins such as polytetrafluoroethylene, monochlorotrifluoroethylene polymer, polyvinylidene fluoride; silicone resins; polyester resins; polyamide resins; polyvinyl butyral; and aminoacrylate resins. Other examples include ionomer resins and polyphenylene sulfide resins. These resins can be used singly or in combination of a plurality thereof.

As a production method of the toner, a pulverization method is exemplified below, but this method is not limiting.

First, the binder resin and, if necessary, other additives are sufficiently mixed with a mixer such as a Henschel mixer or a ball mill.

The obtained mixture is melt-kneaded using a heat kneader such as a heating roll, a kneader, and an extruder to obtain a kneaded material.

The obtained kneaded product is cooled and solidified, pulverized and classified to obtain toner particles.

The toner is then obtained by thoroughly mixing calcium strontium zirconate fine particles and, if necessary, silica fine particles and the like with the toner particles with a mixer such as a Henschel mixer.

Examples of the mixer are presented hereinbelow.

Henschel mixer (manufactured by Mitsui Mining Co., Ltd.); Super Mixer (manufactured by Kawata Company Limited); Ribocone (manufactured by Okawara Mfg. Co., Ltd.); Nauta Mixer, Turbulizer, and Cyclomix (manufactured by Hosokawa Micron Corporation); Spiral Pin Mixer (manufactured by Pacific Machinery & Engineering Co., Ltd.); and Loedige mixer (manufactured by Matsubo Corporation)

Examples of the kneading machine are presented hereinbelow.

KRC kneader (manufactured by Kurimoto Iron Works Co., Ltd.); Buss Co. Kneader (manufactured by Buss Co.); TEM extruder (manufactured by Toshiba Machine Co., Ltd.); TEX twin-screw kneader (manufactured by Japan Steel Works, Ltd.); PCM kneader (manufactured by Ikegai Co., Ltd.); a three-roll mill, a mixing roll mill, a kneader (manufactured by Inoue Seisakusho); Kneadex (manufactured by Mitsui Mining Co., Ltd.); MS Pressurizing Kneader and Kneader Rudder (manufactured by Moriyama Manufacturing Co., Ltd.); and Bunbury mixer (manufactured by Kobe Steel Co., Ltd.)

Examples of the pulverizer are presented hereinbelow.

Counter Jet Mill, Micron Jet, and Inomizer (manufactured by Hosokawa Micron Corporation); IDS type mill and PJM jet pulverizer (manufactured by Nippon Pneumatic Mfg. Co., Ltd.); Cross Jet Mill (manufactured by Kurimoto Tekkosho Co., Ltd.); Ulmax (manufactured by Niso Engineering Co., Ltd.); SK Jet O-Mill (manufactured by Seishin Enterprise Co., Ltd.); Kryptron (manufactured by Kawasaki Heavy Industries, Ltd.); Turbo Mill (manufactured by Turbo Industry Co., Ltd.); and Superrotator (manufactured by Nissin Engineering Co., Ltd.)

Examples of the classifier are presented hereinbelow.

Classique, Micron Classifier, and Spedic Classifier (manufactured by Seishin Enterprise Co., Ltd.); Turbo Classifier (manufactured by Nisshin Engineering Co., Ltd.); Micron separator, Turboplex (ATP), TSP separator, and TTSP separator (manufactured by Hosokawa Micron Corporation); Elbow Jet (manufactured by Nittetsu Mining Co., Ltd.); dispersion separator (manufactured by Nippon Pneumatic Mfg. Co., Ltd.); and YM Microcut (manufactured by Yasukawa Shoji Co., Ltd.)

Examples of the sieving device used for sieving coarse particles are presented hereinbelow.

Ultrasonic (manufactured by Koei Sangyo Co., Ltd.); Resonasieve and Gyrosifter (manufactured by Tokuju Corporation); Vibrasonic System (manufactured by Dalton Co., Ltd.); SoniClean (manufactured by Shinto Kogyo Co., Ltd.); Turbo Cleaner (manufactured by Turbo Industries Co., Ltd.); Micro Sifter (manufactured by Makino Sangyo Co., Ltd.); and a circular vibration sieve The weight average particle size (D4) of the toner is preferably from 4.0 μm to 9.0 μm, more preferably from 4.5 μm to 8.5 μm, and even more preferably from 5.0 μm to 8.0 μm.

In addition, it is preferable that the toner be a negatively chargeable toner.

Next, methods for measuring physical properties according to the present invention will be described.

Method for Measuring X-ray Diffraction Spectrum

The measurement of the X-ray diffraction spectrum is carried out under the following conditions using a measuring apparatus "MiniFlex 600" (manufactured by Rigaku Corporation) and control software and analysis software provided with the apparatus.

A sample (calcium strontium zirconate fine particles) in a powder state is placed, while pressing lightly to flatten the powder, on a nonreflecting sample plate (manufactured by Rigaku) having no diffraction peak within the measurement range. Once the powder has been flattened, the powder and the sample plate are set to the instrument.

Conditions of X-ray Diffraction
Tube: Cu
Parallel Beam Optical System
Voltage: 40 kV
Current: 15 mA
Start angle: 3°
End angle: 60°
Sampling width: 0.02°
Scan speed: 10.00°/min
Divergence slit: 0.625 deg
Scattering slit: 8.0 mm
Receiving slit: 13.0 mm (Open)

When measuring the X-ray diffraction spectrum of the external additive contained in the toner from the toner, the following process may be used.

First, the external additive is separated from the toner. The separation method is described hereinbelow.

A total of 20 mL of an aqueous solution prepared by 50-fold dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.), which is a surfactant, with ion exchanged water is poured in a 50 mL polyethylene bottle vessel.

There, 1.0 g of the toner is added, and a pre-treatment dispersion is prepared by allowing to stand until the toner naturally settles down. This dispersion is shaken with a shaker (YS-8D model: manufactured by Yayoi Co., Ltd.) at a shaking speed of 200 rpm for 20 min to detach the external additive from the surface of the toner particles.

The separation of toner particles and detached external additives is carried out using a centrifugal separator. The centrifugal separation process is carried out at 3700 rpm for 30 min, and the supernatant portion is thereafter collected, filtered and dried, whereby the external additive separated from the toner can be obtained.

Method for Analyzing Composition of Calcium Strontium Zirconate Fine Particle

The composition of calcium strontium zirconate fine particle is directly analyzed by directly measuring the elements from Na to U under a He atmosphere by using a wavelength dispersion type fluorescent X-ray analyzer "Axios advanced, manufactured by Spectris Co.".

A cup for a liquid specimen provided with the device is used, a polypropylene film is stretched over the bottom of the cup, a sufficient amount of the sample is placed in the cup to form a layer with uniform thickness on the bottom, and the cup is closed with a lid.

The measurement is carried out under the condition that the output is 2.4 kW.

For the analysis, a fundamental parameter method is used.

At that time, it is assumed that all the detected elements are oxides, and the total mass of all oxides is assumed to be 100 mass %.

The amount (mass %) of zirconium oxide ($ZrO_2$), calcium oxide (CaO) and strontium oxide (SrO) with respect to the total mass is determined as a value converted to oxide by using the software "UniQuant 5 ver. 5.49 manufactured by Spectris Co.".

Thereafter, the amount of zirconium oxide ($ZrO_2$), calcium oxide (CaO) and strontium oxide (SrO) is converted into mol % by taking the total amount of all oxides as 100 mol %.

Method for Measuring Dielectric Constant

The dielectric constant is measured by the following method.

A total of 1.0 g of the sample is weighed, and a load of 2 MPa is applied to mold the sample into a disk-shaped measurement sample having a diameter of 25 mm and a thickness of 1.5±0.5 mm over 1 min. The weight (gram), load and thickness are checked.

The measurement sample is mounted on ARES-G 2 "manufactured by TA Instruments" equipped with a dielectric constant measuring jig (electrode) having a diameter of 25 mm.

The dielectric constant is calculated from the measured value of the complex permittivity at 1 MHz and 25° C. by using a 4284 A Precision LCR meter (manufactured by Hewlett-Packard) at a measurement temperature of 25° C. under a load of 250 g/cm$^2$.

Method for Measuring Resistivity

Figure 1B:
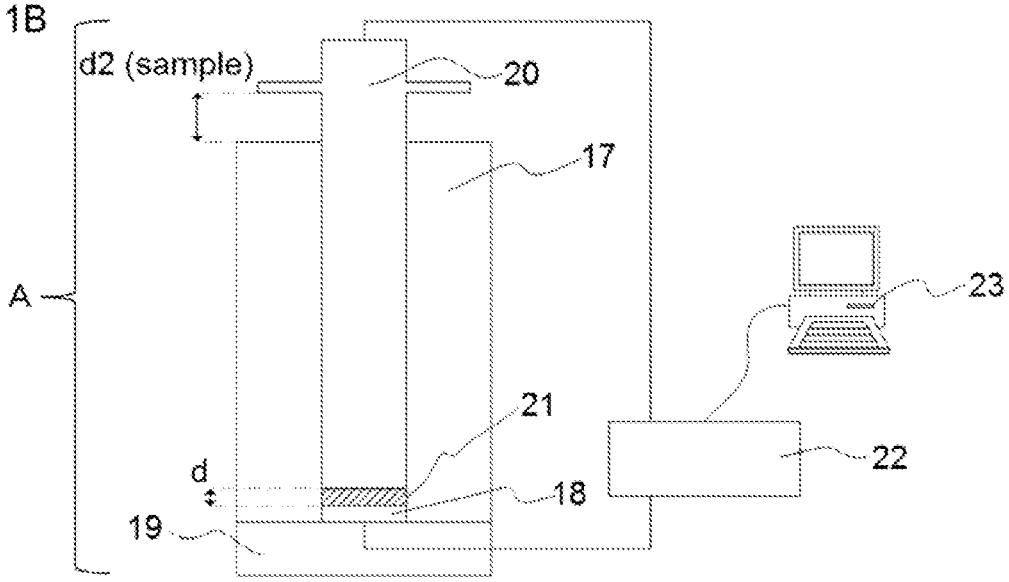

A resistivity at an electric field intensity of 10,000 (V/cm) is measured using a measuring device outlined in FIGS. 1A and 1B.

The resistance measurement cell A is configured of a cylindrical container (made of a PTFE resin) 17 having a hole of 2.4 cm$^2$ in cross section, a lower electrode (made of stainless steel) 18, a support pedestal (made of a PTFE resin) 19, and an upper electrode (made of stainless steel) 20. The cylindrical container 17 is placed on the support pedestal 19, and a sample 21 is filled so as to have a thickness of about 1 mm. The upper electrode 20 is placed on the filled sample 21, and the thickness of the sample is measured. As shown in FIG. 1A, where a gap when no sample is present is denoted by d1 and a gap when the sample is filled so as to have a thickness of about 1 mm, as shown in FIG. 1B, is denoted by d2, the thickness d of the sample is calculated by the following equation.

$$d = d2 - d1 \text{ (mm)}$$

At this time, the mass of the sample is appropriately changed so that the thickness d of the sample is from 0.95 mm to 1.04 mm.

By applying a DC voltage between the electrodes and measuring the current flowing at that time, the resistivity of the sample can be determined.

An electrometer 22 (Keithley 6517A manufactured by Keithley Instruments & Products Co.) is used for the measurement, and a processing computer 23 is used for control.

A control system manufactured by National Instruments and control software (LabVIEW, manufactured by National Instruments) are used as the processing computer for control.

As the measurement conditions, a contact area S=2.4 cm$^2$ between the sample and the electrode, and a measured value d such that the thickness of the sample is from 0.95 mm to 1.04 mm are inputted. Further, the load of the upper electrode 20 is set to 270 g, and the maximum applied voltage is set to 1000 V.

$$\text{Resistivity } (\Omega\cdot\text{cm}) = [\text{applied voltage (V)}/\text{measured current (A)}] \times S\ (\text{cm}^2)/d\ (\text{cm})$$

$$\text{Electric field intensity (V/cm)} = \text{applied voltage (V)}/d\ (\text{cm})$$

The resistivity of the sample at the electric field strength is obtained by reading the resistivity at the electric field intensity on the graph from the graph.

Method for Measuring Number-Average Particle Diameter of Primary Particles of Inorganic Fine Particles The number-average particle diameter of primary particles of the inorganic fine particles is determined by observing the particles under a transmission electron microscope "H-800" (manufactured by Hitachi Ltd.), measuring the major axis of 100 primary particles in a field of view magnified up to a maximum of 2,000,000 times, and obtaining the arithmetic average value thereof.

Method for Measuring Particle Size Distribution of Toner

The particle size distribution of the toner is measured in the following manner.

A precision particle size distribution measuring apparatus "Coulter Counter Multisizer 3" (registered trademark, manufactured by Beckman Coulter, Inc.) equipped with a 100-μm aperture tube and based on a pore electric resistance method is used as a measurement device. The dedicated software "Beckman Coulter Multisizer 3 Version 3.51" (manufactured by Beckman Coulter, Inc.) is used for setting measurement conditions and performing measurement data analysis. The measurements are carried out with 25,000 effective measurement channels.

As electrolytic aqueous solution used in the measurement, a solution in which sodium chloride (Special Grade) is dissolved in ion exchanged water so as to achieve a concentration of about 1% by mass, for example, "ISOTON II" (manufactured by Beckman Coulter, Inc.) can be used.

The dedicated software is set up in the following manner before the measurement and analysis.

The total count number in a control mode is set to 50,000 particles on a "CHANGE STANDARD MEASUREMENT METHOD (SOM)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the measurement button of the threshold/noise level. Further, the current is set to 1600 μA, the gain is set to 2, the electrolytic solution is set to ISOTON II, and "FLUSH OF APERTURE TUBE AFTER MEASUREMENT" is checked.

On the "PULSE TO PARTICLE SIZE CONVERSION SETTING" screen of the dedicated software, the bin interval is set to a logarithmic particle size, the particle size bin is set to a 256-particle size bin, and a particle size range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE" function of the dedicated software.

(2) Approximately 30 ml of the electrolytic aqueous solution is placed in a glass 100 mL flat-bottom beaker. Then, about 0.3 mL of a diluted solution obtained by about 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersant to the electrolytic aqueous solution.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchanged water is poured into a water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the weight-average particle diameter (D4) and number-average particle diameter (D1) are calculated. The "AVERAGE SIZE" on the "ANALYSIS/VOLUME STATISTICAL VALUE (ARITHMETIC MEAN)" screen obtained when the graph/(% by volume) is set in the dedicated software is the weight-average particle diameter (D4).

The "AVERAGE SIZE" on the "ANALYSIS/VOLUME STATISTICAL VALUE (ARITHMETIC MEAN)" screen obtained when the graph/(% by number) is set in the dedicated software is the number-average particle diameter (D1).

EXAMPLES

Hereinafter, the present invention will be specifically described with reference to examples, but the present invention is not limited to these examples. In the examples, parts and percentages are on a mass basis unless otherwise specified.

Production Example of Inorganic Fine Particles 1

Zirconium oxide (number-average particle diameter of primary particles: 80 nm, purity: 97.0% by mass), calcium carbonate (number-average particle diameter of primary particles: 120 nm, purity: 99.0% by mass) and strontium carbonate (number-average particle diameter of primary particles: 120 nm, purity: 99.0% by mass) were each dispersed in water to prepare slurries.

The slurries were mixed so that the molar ratio of zirconium, calcium and strontium was 1:0.7:0.3 to obtain a mixed slurry.

The resulting mixed slurry was spray dried at 200° C. Thereafter, the spray-dried powder was heated in an electric furnace at a temperature of 800° C. for 4 h to obtain inorganic fine particles 1.

As a result of identifying the inorganic fine particles 1 by X-ray diffraction method, it was confirmed that the particles were those of calcium strontium zirconate.

Production Example of Inorganic Fine Particles 2

Inorganic fine particles 2 were obtained in the same manner as in the production example of inorganic fine particles 1, except that mixing was performed so that the molar ratio of zirconium, calcium and strontium was 1:0.73:0.32. As a result of identifying the inorganic fine particles 2 by X-ray diffraction method, it was confirmed that the particles were those of calcium strontium zirconate.

Production Example of Inorganic Fine Particles 3

Inorganic fine particles 3 were obtained in the same manner as in the production example of inorganic fine particles 1, except that mixing was performed so that the molar ratio of zirconium, calcium and strontium was 1:0.67:0.73. As a result of identifying the inorganic fine particles 3 by X-ray diffraction method, it was confirmed that the particles were those of calcium strontium zirconate.

Production Example of Inorganic Fine Particles 4

Zirconium oxide (number-average particle diameter of primary particles: 30 nm, purity: 98.0% by mass), calcium carbonate (number-average particle diameter of primary particles: 40 nm, purity: 99.5% by mass) and strontium carbonate (number-average particle diameter of primary particles: 40 nm, purity: 99.5% by mass) were each dispersed in water to prepare slurries.

The slurries were mixed so that the molar ratio of zirconium, calcium and strontium was 1:0.2:0.9 to obtain a mixed slurry.

The resulting mixed slurry was spray dried at 150° C. Thereafter, the spray-dried powder was heated in an electric furnace at a temperature of 700° C. for 3 h to obtain inorganic fine particles 4.

As a result of identifying the inorganic fine particles 4 by X-ray diffraction method, it was confirmed that the particles were those of calcium strontium zirconate.

Production Example of Inorganic Fine Particles 5

Zirconium oxide (number-average particle diameter of primary particles: 100 nm, purity: 96.0% by mass), calcium carbonate (number-average particle diameter of primary particles: 150 nm, purity: 97.5% by mass) and strontium carbonate (number-average particle diameter of primary particles: 150 nm, purity: 97.5% by mass) were each dispersed in water to prepare slurries.

The slurries were mixed so that the molar ratio of zirconium, calcium and strontium was 1:0.7:0.2 to obtain a mixed slurry.

The resulting mixed slurry was spray dried at 220° C. Thereafter, the spray-dried powder was heated in an electric furnace at a temperature of 700° C. for 4 h to obtain inorganic fine particles 5.

As a result of identifying the inorganic fine particles 5 by X-ray diffraction method, it was confirmed that the particles were those of calcium strontium zirconate.

Production Example of Inorganic Fine Particles 6

Zirconium oxide (number-average particle diameter of primary particles: 100 nm, purity: 96.0% by mass), calcium carbonate (number-average particle diameter of primary particles: 150 nm, purity: 97.5% by mass) and strontium carbonate (number-average particle diameter of primary particles: 150 nm, purity: 97.5% by mass) were each dispersed in water to prepare slurries.

The slurries were mixed so that the molar ratio of zirconium, calcium and strontium was 1:0.66:0.21 to obtain a mixed slurry.

The resulting mixed slurry was spray dried at 220° C. Thereafter, the spray-dried powder was heated in an electric furnace at a temperature of 700° C. for 4 h to obtain inorganic fine particles 6.

As a result of identifying the inorganic fine particles 6 by X-ray diffraction method, it was confirmed that the particles were those of calcium strontium zirconate.

Production Example of Inorganic Fine Particles 7

Zirconium oxide (number-average particle diameter of primary particles: 100 nm, purity: 96.0% by mass), calcium carbonate (number-average particle diameter of primary particles: 150 nm, purity: 97.5% by mass) and strontium carbonate (number-average particle diameter of primary particles: 150 nm, purity: 97.5% by mass) were each dispersed in water to prepare slurries.

The slurries were mixed so that the molar ratio of zirconium, calcium and strontium was 1:0.94:0.24 to obtain a mixed slurry.

The resulting mixed slurry was spray dried at 220° C. Thereafter, the spray-dried powder was heated in an electric furnace at a temperature of 700° C. for 4 h to obtain inorganic fine particles 7.

As a result of identifying the inorganic fine particles 7 by X-ray diffraction method, it was confirmed that the particles were those of calcium strontium zirconate.

Production Example of Inorganic Fine Particles 8

Zirconium oxide (number-average particle diameter of primary particles: 100 nm, purity: 94.0% by mass), calcium carbonate (number-average particle diameter of primary particles: 150 nm, purity: 96.5% by mass) and strontium carbonate (number-average particle diameter of primary particles: 150 nm, purity: 96.5% by mass) were each dispersed in water to prepare slurries.

The slurries were mixed so that the molar ratio of zirconium, calcium and strontium was 1:0.92:0.26 to obtain a mixed slurry.

The resulting mixed slurry was spray dried at 220° C. Thereafter, the spray-dried powder was heated in an electric furnace at a temperature of 700° C. for 4 h to obtain inorganic fine particles 8.

As a result of identifying the inorganic fine particles 8 by X-ray diffraction method, it was confirmed that the particles were those of calcium strontium zirconate.

Production Example of Inorganic Fine Particles 9

Zirconium oxide (number-average particle diameter of primary particles: 100 nm, purity: 94.0% by mass), calcium carbonate (number-average particle diameter of primary particles: 150 nm, purity: 96.5% by mass) and strontium carbonate (number-average particle diameter of primary particles: 150 nm, purity: 96.5% by mass) were each dispersed in water to prepare slurries.

The slurries were mixed so that the molar ratio of zirconium, calcium and strontium was 1:0.94:0.23 to obtain a mixed slurry.

The resulting mixed slurry was spray dried at 220° C. Thereafter, the spray-dried powder was heated in an electric furnace at a temperature of 700° C. for 4 h to obtain inorganic fine particles 9.

As a result of identifying the inorganic fine particles 9 by X-ray diffraction method, it was confirmed that the particles were those of calcium strontium zirconate.

Production Example of Inorganic Fine Particles 10

Zirconium oxide (number-average particle diameter of primary particles: 100 nm, purity: 94.0% by mass), calcium carbonate (number-average particle diameter of primary particles: 150 nm, purity: 96.5% by mass) and strontium carbonate (number-average particle diameter of primary particles: 150 nm, purity: 96.5% by mass) were each dispersed in water to prepare slurries.

The slurries were mixed so that the molar ratio of zirconium, calcium and strontium was 1:0.23:0.94 to obtain a mixed slurry.

The resulting mixed slurry was spray dried at 220° C. Thereafter, the spray-dried powder was heated in an electric furnace at a temperature of 700° C. for 4 h to obtain inorganic fine particles 10.

As a result of identifying the inorganic fine particles 10 by X-ray diffraction method, it was confirmed that the particles were those of calcium strontium zirconate.

Production Example of Inorganic Fine Particles 11

Zirconium oxide (number-average particle diameter of primary particles: 180 nm, purity: 92.0% by mass), calcium carbonate (number-average particle diameter of primary particles: 200 nm, purity: 93.5% by mass) and strontium carbonate (number-average particle diameter of primary particles: 200 nm, purity: 93.5% by mass) were each dispersed in water to prepare slurries.

The slurries were mixed so that the molar ratio of zirconium, calcium and strontium was 1:0.23:0.94 to obtain a mixed slurry.

The resulting mixed slurry was spray dried at 250° C. Thereafter, the spray-dried powder was heated in an electric furnace at a temperature of 800° C. for 4 h 30 min to obtain inorganic fine particles 11.

As a result of identifying the inorganic fine particles 11 by X-ray diffraction method, it was confirmed that the particles were those of calcium strontium zirconate.

Production Example of Inorganic Fine Particles 12

Zirconium oxide (number-average particle diameter of primary particles: 5 nm, purity: 97.0% by mass), calcium carbonate (number-average particle diameter of primary particles: 10 nm, purity: 99.5% by mass) and strontium carbonate (number-average particle diameter of primary particles: 10 nm, purity: 99.5% by mass) were each dispersed in water to prepare slurries.

The slurries were mixed so that the molar ratio of zirconium, calcium and strontium was 1:0.23:0.94 to obtain a mixed slurry.

The resulting mixed slurry was spray dried at 130° C. Thereafter, the spray-dried powder was heated in an electric furnace at a temperature of 650° C. for 2 h to obtain inorganic fine particles 12.

As a result of identifying the inorganic fine particles 12 by X-ray diffraction method, it was confirmed that the particles were those of calcium strontium zirconate.

Production Example of Inorganic Fine Particles 13

Zirconium oxide (number-average particle diameter of primary particles: 180 nm, purity: 95.0% by mass), calcium carbonate (number-average particle diameter of primary particles: 200 nm, purity: 97.5% by mass) and strontium carbonate (number-average particle diameter of primary particles: 200 nm, purity: 97.5% by mass) were each dispersed in water to prepare slurries.

The slurries were mixed so that the molar ratio of zirconium, calcium and strontium was 1:0.23:0.94 to obtain a mixed slurry.

The resulting mixed slurry was spray dried at 260° C. Thereafter, the spray-dried powder was heated in an electric furnace at a temperature of 820° C. for 5 h to obtain inorganic fine particles 13.

As a result of identifying the inorganic fine particles 13 by X-ray diffraction method, it was confirmed that the particles were those of calcium strontium zirconate.

Production Example of Inorganic Fine Particles 14

Zirconium oxide (number-average particle diameter of primary particles: 150 nm, purity: 92.0% by mass), calcium carbonate (number-average particle diameter of primary particles: 180 nm, purity: 93.5% by mass) and strontium carbonate (number-average particle diameter of primary particles: 180 nm, purity: 93.5% by mass) were each dispersed in water to prepare slurries.

The slurries were mixed so that the molar ratio of zirconium, calcium and strontium was 1:0.24:0.93 to obtain a mixed slurry.

The resulting mixed slurry was spray dried at 260° C. Thereafter, the spray-dried powder was heated in an electric furnace at a temperature of 820° C. for 5 h to obtain inorganic fine particles 14.

As a result of identifying the inorganic fine particles 14 by X-ray diffraction method, it was confirmed that the particles were those of calcium strontium zirconate.

Production Example of Inorganic Fine Particles 15

Zirconium oxide (number-average particle diameter of primary particles: 170 nm, purity: 91.0% by mass), calcium carbonate (number-average particle diameter of primary particles: 160 nm, purity: 92.5% by mass) and strontium carbonate (number-average particle diameter of primary particles: 160 nm, purity: 92.5% by mass) were each dispersed in water to prepare slurries.

The slurries were mixed so that the molar ratio of zirconium, calcium and strontium was 1:0.24:0.93 to obtain a mixed slurry.

The resulting mixed slurry was spray dried at 260° C. Thereafter, the spray-dried powder was heated in an electric furnace at a temperature of 820° C. for 5 h to obtain inorganic fine particles 15.

As a result of identifying the inorganic fine particles 15 by X-ray diffraction method, it was confirmed that the particles were those of calcium strontium zirconate.

Production Example of Inorganic Fine Particles 16

Zirconium oxide (number-average particle diameter of primary particles: 170 nm, purity: 91.0% by mass), calcium carbonate (number-average particle diameter of primary particles: 160 nm, purity: 92.5% by mass) and strontium carbonate (number-average particle diameter of primary particles: 160 nm, purity: 92.5% by mass) were each dispersed in water to prepare slurries.

The slurries were mixed so that the molar ratio of zirconium, calcium and strontium was 1:0.24:0.93 to obtain a mixed slurry.

The resulting mixed slurry was spray dried at 250° C. Thereafter, the spray-dried powder was heated in an electric furnace at a temperature of 800° C. for 5 h to obtain inorganic fine particles 16.

As a result of identifying the inorganic fine particles 16 by X-ray diffraction method, it was confirmed that the particles were those of calcium strontium zirconate.

Production Example of Inorganic Fine Particles 17

Zirconium oxide (number-average particle diameter of primary particles: 180 nm, purity: 92.0% by mass), calcium carbonate (number-average particle diameter of primary particles: 200 nm, purity: 92.5% by mass) and strontium carbonate (number-average particle diameter of primary particles: 200 nm, purity: 92.5% by mass) were each dispersed in water to prepare slurries.

The slurries were mixed so that the molar ratio of zirconium, calcium and strontium was 1:0.17:1.00 to obtain a mixed slurry.

The resulting mixed slurry was spray dried at 230° C. Thereafter, the spray-dried powder was heated in an electric furnace at a temperature of 780° C. for 5 h to obtain inorganic fine particles 17.

As a result of identifying the inorganic fine particles 17 by X-ray diffraction method, it was confirmed that the particles were those of calcium strontium zirconate.

Production Example of Inorganic Fine Particles 18

Zirconium oxide (number-average particle diameter of primary particles: 180 nm, purity: 92.0% by mass), calcium carbonate (number-average particle diameter of primary particles: 200 nm, purity: 92.5% by mass) and strontium carbonate (number-average particle diameter of primary particles: 200 nm, purity: 92.5% by mass) were each dispersed in water to prepare slurries.

The slurries were mixed so that the molar ratio of zirconium, calcium and strontium was 1:1.00:0.17 to obtain a mixed slurry.

The resulting mixed slurry was spray dried at 250° C. Thereafter, the spray-dried powder was heated in an electric furnace at a temperature of 780° C. for 5 h to obtain inorganic fine particles 18.

As a result of identifying the inorganic fine particles 18 by X-ray diffraction method, it was confirmed that the particles were those of calcium strontium zirconate.

Production Example of Inorganic Fine Particles 19

Zirconium oxide (number-average particle diameter of primary particles: 180 nm, purity: 92.0% by mass) and calcium carbonate (number-average particle diameter of primary particles: 200 nm, purity: 92.5% by mass) were each dispersed in water to prepare slurries.

The slurries were mixed so that the molar ratio of zirconium and calcium was 1:1 to obtain a mixed slurry.

The resulting mixed slurry was spray dried at 250° C. Thereafter, the spray-dried powder was heated in an electric furnace at a temperature of 780° C. for 5 h to obtain inorganic fine particles 19.

As a result of identifying the inorganic fine particles 19 by X-ray diffraction method, it was confirmed that the particles were those of calcium zirconate.

Production Example of Inorganic Fine Particles 20

Zirconium oxide (number-average particle diameter of primary particles: 180 nm, purity: 92.0% by mass) and strontium carbonate (number-average particle size of primary particles: 200 nm, purity: 92.5% by mass) were each dispersed in water to prepare slurries.

The slurries were mixed so that the molar ratio of zirconium and strontium was 1:1 to obtain a mixed slurry.

The resulting mixed slurry was spray dried at 250° C. Thereafter, the spray-dried powder was heated in an electric furnace at a temperature of 780° C. for 5 h to obtain inorganic fine particles 20.

As a result of identifying the inorganic fine particles 20 by X-ray diffraction method, it was confirmed that the particles were those of strontium zirconate.

Production Example of Inorganic Fine Particles 21

Hydrochloric acid was added to a slurry in which zirconium oxide (number-average particle diameter of primary particles: 180 nm, purity: 92.0% by mass) was dispersed in water to obtain pH 1.2 and the slurry was subjected to deflocculation treatment.

Thereafter, a calcium chloride aqueous solution was added so that the molar ratio to zirconium became 1.1 times, and the pH was adjusted to 13.0 by adding 10 mol/L sodium hydroxide solution. Then, nitrogen gas was blown thereinto, the mixed solution was allowed to stand for 20 min, and then the interior of the reaction vessel was replaced with nitrogen gas.

The mixed solution was heated to 155° C. in an autoclave while allowing nitrogen to flow to the reaction vessel and further stirring and mixing, and stirring and holding were continued for 3 h to form calcium zirconate fine particles.

Subsequently, the slurry was cooled until the slurry temperature reached 50° C. Then, an aqueous calcium hydroxide solution was gradually added while blowing carbon dioxide gas into the reaction vessel, and stirring was performed for 2 h. The resulting slurry was filtered, washed and dried, and then pulverized using a hammer mill to obtain inorganic fine particles 21.

As a result of identifying the inorganic fine particles 21 by X-ray diffraction method, it was confirmed that the particles were those of calcium zirconate.

X-ray diffraction analysis, fluorescent X-ray analysis, and measurement of dielectric constant, resistivity and number-average particle diameter of primary particles were carried out with respect to the obtained inorganic fine particles 1 to 21.

Physical properties of inorganic fine particles are shown in Table 1.

TABLE 1

| Inorganic fine particle No. | Maximum peak of diffraction angle 2θ (deg) | Dielectric constant (pF/m) | Resistivity (Ω × cm) | Number-average particle diameter of primary particles (nm) | Composition of calcium strontium zirconate fine particles: Zirconium oxide (mol %) | Calcium oxide (mol %) | Strontium oxide (mol %) |
|---|---|---|---|---|---|---|---|
| 1 | 31.30 | 70 | $1.5 \times 10^8$ | 250 | 48.0 | 34.0 | 14.0 |
| 2 | 31.30 | 72 | $2.7 \times 10^8$ | 250 | 46.8 | 34.2 | 15.0 |
| 3 | 31.30 | 67 | $3.7 \times 10^8$ | 250 | 49.2 | 32.8 | 14.0 |
| 4 | 30.95 | 50 | $1.2 \times 10^7$ | 30 | 45.5 | 10.0 | 40.5 |
| 5 | 31.35 | 100 | $8.7 \times 10^7$ | 350 | 47.1 | 32.9 | 10.0 |
| 6 | 31.37 | 102 | $1.6 \times 10^9$ | 350 | 48.1 | 31.9 | 10.0 |
| 7 | 31.38 | 104 | $2.1 \times 10^9$ | 350 | 41.3 | 38.9 | 10.0 |
| 8 | 31.36 | 106 | $3.8 \times 10^9$ | 350 | 39.1 | 35.9 | 10.0 |
| 9 | 31.39 | 102 | $4.2 \times 10^9$ | 350 | 39.1 | 36.9 | 9.0 |
| 10 | 30.94 | 110 | $6.3 \times 10^9$ | 350 | 39.1 | 9.0 | 36.9 |
| 11 | 30.94 | 120 | $7.7 \times 10^9$ | 800 | 39.1 | 9.0 | 36.9 |
| 12 | 30.94 | 20 | $8.7 \times 10^9$ | 10 | 39.1 | 9.0 | 36.9 |
| 13 | 30.94 | 125 | $1.0 \times 10^{10}$ | 810 | 39.1 | 9.0 | 36.9 |
| 14 | 30.95 | 125 | $2.1 \times 10^{12}$ | 810 | 34.4 | 9.0 | 31.6 |
| 15 | 30.96 | 125 | $2.6 \times 10^{13}$ | 810 | 34.4 | 6.0 | 34.6 |
| 16 | 30.96 | 130 | $2.7 \times 10^{13}$ | 810 | 34.4 | 34.6 | 6.0 |
| 17 | 30.90 | 130 | $3.3 \times 10^{13}$ | 810 | 34.4 | 5.0 | 35.6 |
| 18 | 31.42 | 130 | $5.1 \times 10^{13}$ | 810 | 34.4 | 35.6 | 5.0 |
| 19 | 31.52 | 150 | $2.5 \times 10^6$ | 530 | 46.0 | 46.0 | — |
| 20 | 30.80 | 140 | $3.2 \times 10^6$ | 530 | 46.0 | — | 46.0 |
| 21 | 31.52 | 120 | $3.2 \times 10^7$ | 100 | 45.0 | 45.0 | — |

Production Example of Binder Resin 1

Bisphenol A ethylene oxide (2.2 mol adduct): 60.0 mol parts

Bisphenol A propylene oxide (2.2 mol adduct): 40.0 mol parts

Terephthalic acid: 80.0 mol parts

Trimellitic anhydride: 20.0 parts by mol

The monomers were charged in a 5 L autoclave. A reflux condenser, a moisture separator, an $N_2$ gas inlet tube, a thermometer and a stirrer were attached thereto, and a condensation polymerization reaction was carried out at 230° C. while introducing $N_2$ gas into the autoclave. After completion of the reaction, the reaction product was taken out from the autoclave, cooled and pulverized to obtain a binder resin 1.

Example 1

Production Example of Toner 1

| | |
|---|---|
| Binder resin 1 | 100 parts |
| Fischer-Tropsch wax (Melting point 105° C.) | 5 parts |
| Magnetic iron oxide particles: (Number-average particle diameter 0.20 μm, Hc (coercive force) = 10 kA/m, σs (saturation magnetization) = 83 $Am^2/kg$, σr (residual magnetization) = 13 $Am^2/kg$) | 90 parts |
| Aluminum compound of 3,5-di-tert-butylsalicylic acid | 1 part |

The above materials were mixed with a Henschel mixer and then melt-kneaded with a twin-screw kneading extruder. The obtained kneaded product was cooled and roughly pulverized with a hammer mill.

Thereafter, the mixture was pulverized with a jet mill, and the finely pulverized powder obtained was classified using a multi-division classifier utilizing the Coanda effect to obtain toner particles of negative triboelectric chargeability having a weight-average particle diameter (D4) of 6.8 μm.

To 100 parts of the toner particles, 1.0 part of the inorganic fine particles 1 and 2.0 parts of hydrophobilized silica fine particles (specific surface area determined by nitrogen adsorption measured by a BET method of 140 $m^2/g$) were externally added and mixed. Thereafter, the mixture was sieved with a mesh having an opening of 150 μm to obtain a toner 1. The formulation of Toner 1 is shown in Table 2.

An evaluation machine used for evaluating the toner was obtained by modifying the process speed of a commercially available digital copying machine (image RUNNER ADVANCE 4551i, manufactured by Canon Inc.) to 252 mm/s.

Evaluation of Halftone Non-Uniformity

For evaluation of halftone non-uniformity, a halftone image of 2 dots and 3 spaces was outputted at a resolution of 600 dpi under a high-temperature and high-humidity (30° C., 80% RH) environment, and halftone image quality (shading non-uniformity in development) was visually evaluated for the obtained image.

The evaluation paper was CS-520 (52.0 g/m$^2$ paper, A4, sold by Canon Marketing Japan Co., Ltd.). The evaluation paper was used after being allowed to stand in a high-temperature and high-humidity environment for 48 hours or more to sufficiently absorb moisture.

Evaluation Criteria

A: Shading non-uniformity is not felt.

B: Slight shading non-uniformity is observed, but it is not bothersome.

C: Some shading non-uniformity is observed.

D: Shading non-uniformity can be confirmed.

E: Shading non-uniformity is very conspicuous.

Evaluation of Scattering

Evaluation of scattering was performed under a high-temperature and high-humidity (30° C., 80% RH) environment.

The evaluation paper was CS-520 (52.0 g/m$^2$ paper, A4, sold by Canon Marketing Japan Co., Ltd.). The evaluation paper was used after being allowed to stand in a high-temperature and high-humidity environment for 48 hours or more to sufficiently absorb moisture.

Evaluation of scattering was carried out by printing a lattice pattern (interval of 1 cm) on a 100 μm (latent image) line, and the scattering was visually evaluated using an optical microscope.

Evaluation Criteria

A: The line is very sharp and there is hardly any scattering.

B: The line is sharp with slight scattering.

C: Scattering is somewhat large but the line is relatively sharp.

D: Scattering is quite large, and the line feels to be blurred.

E: Worse than D.

Evaluation of Image Density

Ten sheets of a test chart with a print percentage of 5% were continuously passed in various environments [under a normal-temperature and normal-humidity (23° C., 55% RH) environment, under a high-temperature and high-humidity (30° C., 80% RH) environment, and under a low-temperature and low-humidity (5° C., 5% RH) environment], followed by evaluation.

Under the low-temperature and low-humidity environment, thereafter, 10,000 sheets were continuously passed, and then, the same evaluation was performed to evaluate whether excessive charging of the toner could be suppressed.

When the toner is excessively charged due to continuous passing of 10,000 sheets, the image density of the toner is lowered.

CS-680 (68.0 g/m$^2$ paper, A4, sold by Canon Marketing Japan Co., Ltd.) was used as the evaluation paper.

As the evaluation method, an original image in which a solid black patch of 20 mm square was arranged in 5 locations in the development area was outputted, and the 5-point average was taken as the image density.

The image density was measured using an X-Rite color reflection densitometer (X-rite 500 Series manufactured by X-rite Co., Ltd.).

Evaluation Criteria

A: Image density 1.45 or more

B: Image density 1.40 or more to less than 1.45

C: Image density 1.35 or more to less than 1.40

D: Image density 1.30 or more to less than 1.35

E: Image density less than 1.30

Evaluation of Fogging

In evaluation of fogging, ten sheets of a test chart with a print percentage of 5% were continuously passed in various environments [under a normal-temperature and normal-humidity (23° C., 55% RH) environment, under a high-temperature and high-humidity (30° C., 80% RH) environment, and under a low-temperature and low-humidity (5° C., 5% RH) environment], followed by evaluation.

Under the low-temperature and low-humidity environment, thereafter, 10,000 sheets were continuously passed, and then, the same evaluation was performed to evaluate whether excessive charging of the toner could be suppressed.

When the toner is excessively charged due to continuous passing of 10,000 sheets, occurrence of fogging becomes remarkable.

For the evaluation method, a solid white image was evaluated according to the following criteria.

The measurement was carried out using a reflectometer (Reflectometer Model TC-6DS, Tokyo Denshoku Co., Ltd.), the worst value of the white background reflection density after image formation was denoted by Ds, the reflection average density of the transfer material before image formation was denoted by Dr, and Dr-Ds was used as fogging amount to evaluate fogging. Therefore, the smaller the numerical value, the smaller the occurrence of fog.

Evaluation Criteria

A: Fogging is less than 1.0.

B: Fogging is 1.0 or more and less than 2.0.

C: Fogging is 2.0 or more and less than 3.0.

D: Fogging is 3.0 or more and less than 4.0.

E: Fogging is 4.0 or more.

Production Examples of Toners 2 to 22

Toners 2 to 22 were obtained in the same manner as in Production Example of Toner 1 except that the kind and addition amount of the inorganic fine particles were changed as shown in Table 2.

Examples 2 to 22

Toners 2 to 22 were evaluated by the same methods as in Example 1. The evaluation results are shown in Tables 3 and 4.

TABLE 2

| Toner No. | Inorganic fine particle No. | Addition amount of inorganic fine particle (parts by mass) |
|---|---|---|
| 1 | 1 | 1.0 |
| 2 | 2 | 0.1 |
| 3 | 3 | 3.0 |
| 4 | 4 | 3.0 |
| 5 | 5 | 3.0 |
| 6 | 6 | 3.0 |
| 7 | 7 | 3.0 |
| 8 | 8 | 3.0 |
| 9 | 9 | 3.0 |
| 10 | 10 | 3.0 |
| 11 | 11 | 3.0 |
| 12 | 12 | 3.0 |
| 13 | 13 | 3.0 |
| 14 | 13 | 0.05 |
| 15 | 13 | 5.0 |

TABLE 2-continued

| Toner No. | Inorganic fine particle No. | Addition amount of inorganic fine particle (parts by mass) |
|---|---|---|
| 16 | 13 | 10.0 |
| 17 | 13 | 11.0 |
| 18 | 14 | 11.0 |
| 19 | 15 | 11.0 |
| 20 | 16 | 11.0 |
| 21 | 17 | 11.0 |
| 22 | 18 | 11.0 |

TABLE 3

| | Toner No. | Halftone non-uniformity (high-temperature and high-humidity environment) Rank | Scattering (high-temperature and high-humidity environment) Rank | Image density (high-temperature and high-humidity environment) Rank (image density) | Fogging (high-temperature and high-humidity environment) Rank (fogging) |
|---|---|---|---|---|---|
| Example 1 | 1 | A | A | A (1.48) | A (0.1) |
| Example 2 | 2 | A | A | A (1.48) | A (0.1) |
| Example 3 | 3 | A | A | A (1.48) | A (0.1) |
| Example 4 | 4 | A | A | A (1.47) | A (0.2) |
| Example 5 | 5 | A | A | A (1.47) | A (0.2) |
| Example 6 | 6 | A | A | A (1.47) | A (0.2) |
| Example 7 | 7 | A | A | A (1.47) | A (0.2) |
| Example 8 | 8 | A | A | A (1.47) | A (0.2) |
| Example 9 | 9 | A | A | A (1.47) | A (0.2) |
| Example 10 | 10 | A | A | A (1.47) | A (0.2) |
| Example 11 | 11 | A | B | A (1.47) | A (0.3) |
| Example 12 | 12 | A | B | A (1.46) | A (0.3) |
| Example 13 | 13 | A | B | A (1.46) | A (0.3) |
| Example 14 | 14 | B | B | A (1.46) | A (0.3) |
| Example 15 | 15 | B | B | A (1.46) | A (0.4) |
| Example 16 | 16 | B | B | A (1.46) | A (0.5) |
| Example 17 | 17 | B | B | A (1.46) | A (0.6) |
| Example 18 | 18 | B | B | A (1.45) | A (0.7) |
| Example 19 | 19 | B | B | A (1.45) | A (0.8) |
| Example 20 | 20 | B | C | A (1.45) | A (0.9) |
| Example 21 | 21 | C | C | A (1.45) | A (0.9) |
| Example 22 | 22 | C | C | A (1.45) | A (0.9) |

TABLE 4

| | Toner No. | Image density (after 10 sheets) (low-temperature and low-humidity environment) Rank (image density) | Fogging (after 10 sheets) (low-temperature and low-humidity environment) Rank (fogging) | Image density (after 10,000 sheets) (low-temperature and low-humidity environment) Rank (image density) | Fogging (after 10,000 sheets) (low-temperature and low-humidity environment) Rank (fogging) | Image density (normal-temperature and normal-humidity environment) Rank (image density) | Fogging (normal-temperature and normal-humidity environment) Rank (fogging) |
|---|---|---|---|---|---|---|---|
| Example 1 | 1 | A(1.50) | A(0.2) | A(1.50) | A(0.2) | A(1.48) | A(0.1) |
| Example 2 | 2 | A(1.50) | A(0.2) | A(1.50) | A(0.2) | A(1.48) | A(0.1) |
| Example 3 | 3 | A(1.50) | A(0.2) | A(1.50) | A(0.3) | A(1.48) | A(0.1) |
| Example 4 | 4 | A(1.49) | A(0.7) | A(1.49) | A(0.7) | A(1.48) | A(0.1) |
| Example 5 | 5 | A(1.48) | A(0.8) | A(1.48) | A(0.8) | A(1.48) | A(0.1) |
| Example 6 | 6 | A(1.47) | A(0.9) | A(1.47) | B(1.1) | A(1.48) | A(0.1) |
| Example 7 | 7 | A(1.45) | A(0.9) | A(1.45) | B(1.2) | A(1.48) | A(0.2) |
| Example 8 | 8 | A(1.45) | B(1.1) | A(1.45) | B(1.2) | A(1.48) | A(0.2) |
| Example 9 | 9 | A(1.45) | B(1.3) | B(1.44) | B(1.4) | A(1.47) | A(0.2) |
| Example 10 | 10 | A(1.45) | B(1.4) | B(1.43) | B(1.5) | A(1.47) | A(0.2) |
| Example 11 | 11 | A(1.45) | B(1.5) | B(1.43) | B(1.5) | A(1.47) | A(0.2) |
| Example 12 | 12 | A(1.45) | B(1.6) | B(1.42) | B(1.7) | A(1.47) | A(0.3) |
| Example 13 | 13 | B(1.44) | B(1.7) | B(1.42) | B(1.8) | A(1.47) | A(0.3) |
| Example 14 | 14 | B(1.43) | B(1.7) | B(1.41) | B(1.8) | A(1.47) | A(0.4) |
| Example 15 | 15 | B(1.42) | B(1.8) | B(1.40) | B(1.9) | A(1.47) | A(0.5) |
| Example 16 | 16 | B(1.40) | B(1.9) | B(1.40) | C(2.1) | A(1.47) | A(0.6) |

TABLE 4-continued

| | Toner No. | Image density (after 10 sheets) (low-temperature and low-humidity environment) Rank (image density) | Fogging (after 10 sheets) (low-temperature and low-humidity environment) Rank (fogging) | Image density (after 10,000 sheets) (low-temperature and low-humidity environment) Rank (image density) | Fogging (after 10,000 sheets) (low-temperature and low-humidity environment) Rank (fogging) | Image density (normal-temperature and normal-humidity environment) Rank (image density) | Fogging (normal-temperature and normal-humidity environment) Rank (fogging) |
|---|---|---|---|---|---|---|---|
| Example 17 | 17 | B(1.40) | C(2.1) | B(1.40) | C(2.1) | A(1.46) | A(0.6) |
| Example 18 | 18 | B(1.40) | C(2.1) | C(1.39) | C(2.2) | A(1.46) | A(0.7) |
| Example 19 | 19 | C(1.39) | C(2.2) | C(1.39) | C(2.3) | A(1.46) | A(0.7) |
| Example 20 | 20 | C(1.39) | C(2.2) | C(1.39) | C(2.5) | A(1.45) | A(0.8) |
| Example 21 | 21 | C(1.38) | C(2.3) | C(1.38) | C(2.6) | A(1.45) | A(0.8) |
| Example 22 | 22 | C(1.37) | C(2.3) | C(1.38) | C(2.6) | A(1.45) | A(0.8) |

Production Examples of Toners 23 to 25

Toners 23 to 25 were obtained in the same manner as in Production Example of Toner 1 except that the kind and amount of inorganic fine particles were changed as shown in Table 5.

TABLE 5

| Toner No. | Inorganic fine particle No. | Addition amount of inorganic fine particle (parts by mass) |
|---|---|---|
| 23 | 19 | 1.0 |
| 24 | 20 | 1.0 |
| 25 | 21 | 1.0 |

Comparative Examples 1 to 3

Toners 23 to 25 were evaluated by the same method as in Example 1. The evaluation results are shown in Tables 6 and 7.

TABLE 6

| | Toner No. | Halftone non-uniformity (high-temperature and high-humidity environment) Rank | Scattering (high-temperature and high-humidity environment) Rank | Image density (high-temperature and high-humidity environment) Rank (image density) | Fogging (high-temperature and high-humidity environment) Rank (fogging) |
|---|---|---|---|---|---|
| Comparative Example 1 | 23 | E | E | A (1.46) | A (0.5) |
| Comparative Example 2 | 24 | E | E | A (1.45) | A (0.8) |
| Comparative Example 3 | 25 | E | E | A (1.45) | A (0.9) |

TABLE 7

| | Toner No. | Image density (after 10 sheets) (low-temperature and low-humidity environment) Rank (image density) | Fogging (after 10 sheets) (low- temperature and low-humidity environment) Rank (fogging) | Image density (after 10,000 sheets) (low-temperature and low-humidity environment) Rank (image density) | Fogging (after 10,000 sheets) (low-temperature and low-humidity environment) Rank (fogging) | Image density (normal-temperature and normal-humidity environment) Rank (image density) | Fogging (normal-temperature and normal-humidity environment) Rank (fogging) |
|---|---|---|---|---|---|---|---|
| Comparative Example 1 | 23 | D(1.34) | D(3.1) | D(1.32) | D(3.1) | A(1.46) | A(0.5) |
| Comparative Example 2 | 24 | D(1.34) | D(3.2) | D(1.31) | D(3.8) | A(1.45) | A(0.8) |

TABLE 7-continued

| | Toner No. | Image density (after 10 sheets) (low-temperature and low-humidity environment) Rank (image density) | Fogging (after 10 sheets) (low- temperature and low-humidity environment) Rank (fogging) | Image density (after 10,000 sheets) (low-temperature and low-humidity environment) Rank (image density) | Fogging (after 10,000 sheets) (low-temperature and low-humidity environment) Rank (fogging) | Image density (normal-temperature and normal-humidity environment) Rank (image density) | Fogging (normal-temperature and normal-humidity environment) Rank (fogging) |
|---|---|---|---|---|---|---|---|
| Comparative Example 3 | 25 | B(1.44) | B(1.3) | B(1.42) | B(1.6) | A(1.45) | A(0.9) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-221795, filed Nov. 17, 2017, which is hereby incorporated by reference herein in its entirety.

What is claimed is:

1. A toner, comprising:

a toner particle including a binder resin; and an inorganic fine particle, the inorganic fine particle including a calcium strontium zirconate fine particle, wherein a number-average particle diameter of primary particles of the calcium strontium zirconate fine particle is 10 to 800 nm.

2. The toner according to claim 1, wherein the calcium strontium zirconate fine particle has a maximum peak of a diffraction angle 2θ in the range of 30.90 to 31.42 deg in an X-ray diffraction spectrum using a CuKα ray.

3. The toner according to claim 1, wherein the calcium strontium zirconate fine particle has a dielectric constant of 20 to 125 pF/m.

4. The toner according to claim 1, wherein the calcium strontium zirconate fine particle has a resistivity of $1.0\times10^{7}$ to $1.0\times10^{12}$ Ω·cm.

5. The toner according to claim 1, wherein an amount of the calcium strontium zirconate fine particle is 0.05 to 10.0 parts by mass with respect to 100 parts by mass of the toner particle.

* * * * *